United States Patent [19]

Karlsson et al.

[11] 4,011,605

[45] Mar. 15, 1977

[54] FLUSHING AND REFILLING APPARATUSES

[75] Inventors: Frans Harry Karlsson, Lund; Per Torsten Faxen, Bromma, both of Sweden

[73] Assignee: Hykon-Patent Aktiebolag, Lund, Sweden

[22] Filed: Dec. 12, 1974

[21] Appl. No.: 532,115

[30] Foreign Application Priority Data

Dec. 12, 1973 Sweden ..... 7316760

[52] U.S. Cl. ..... 4/41; 4/67 R; 4/249

[51] Int. Cl.[2] ..... E03D 1/36

[58] Field of Search ..... 4/1, 18, 33, 41, 52, 4/28, 55, 56, 57, 58, 60, 65, 67 R, 249

[56] References Cited

UNITED STATES PATENTS

| | | | |
|---|---|---|---|
| 755,166 | 3/1904 | Phillips | 4/55 |
| 768,688 | 8/1904 | Phillips | 4/55 |
| 2,879,521 | 3/1959 | Brasher | 4/56 |
| 2,882,533 | 4/1959 | Gray | 4/52 X |
| 3,619,821 | 11/1971 | Bobo | 4/55 X |
| 3,750,195 | 8/1973 | Roosa | 4/41 X |
| 3,810,261 | 5/1974 | Hollander | 4/41 |
| 3,934,276 | 1/1976 | Karlsson et al. | 4/41 |

FOREIGN PATENTS OR APPLICATIONS

| | | | |
|---|---|---|---|
| 113,731 | 10/1899 | Germany | 4/33 |
| 587,295 | 4/1958 | Italy | 4/58 |
| 217,668 | 12/1967 | Sweden | 4/41 |
| 176,796 | 10/1961 | Sweden | 4/28 |

*Primary Examiner*—Richard E. Aegerter
*Assistant Examiner*—Stuart S. Levy
*Attorney, Agent, or Firm*—Beveridge, DeGrandi, Kline & Lunsford

[57] ABSTRACT

A flushing and refilling apparatus for use in a flushing cistern includes flushing and refilling valves, an overflow member and a common support having quick release coupling means for easy mounting and dismounting of said apparatus and said overflow member as a unit of assembled parts.

7 Claims, 2 Drawing Figures

Figure 1:
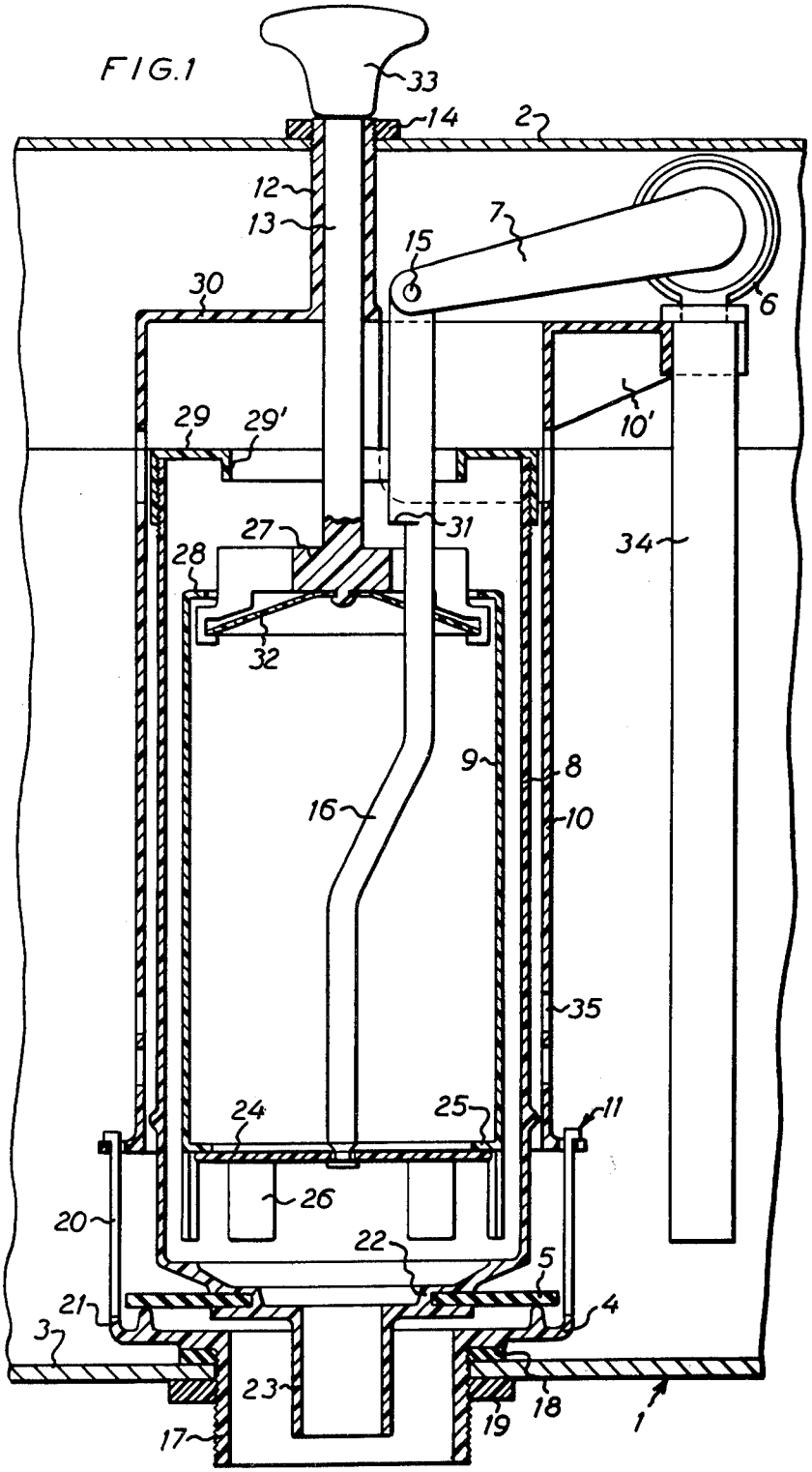

33
14
2
12
13
7
15
30
6
29
29'
10'
27
31
34
28
32
9
8
16
10
35
24
25
11
26
20
22
5
21
4
3
23
18
19
1
17

FLUSHING AND REFILLING APPARATUSES

This invention relates to flushing and refilling apparatuses for use with flushing cisterns and in particular with water closet cisterns.

In known water closet installations the closet is flushed by unseating a flushing valve in the flushing cistern to allow water to flow from the cistern to the pan. The unseating of the flushing valve for flushing the cistern is accompanied by the opening of a refilling valve to start a flushing and refilling cycle. The flushing completed, the flushing valve returns by gravity to its closed position, whereupon the cistern is filled by water entering through the open refilling valve. The refilling cycle is completed in that the refilling valve is closed by a refilling valve closing means which is actuated by water when the cistern is filled up to a predetermined level. There are two main systems for closing the refilling valve automatically in dependence upon the water in the cistern. In the first system the refilling valve closing means comprises a float placed in the tank and connected by links to the refilling valve. According to the second system, to which this invention relates, the refilling valve closing means includes an overflow and a valve closing element connected to the refilling valve and mounted in the overflow to be acted upon by water flowing into the overflow and thereby to effect closing of the refilling valve.

Experience has shown that the flushing and refilling valves with their operating means are apt to give rise to functional disturbances in the flushing cistern. Consequently, the several elements forming the flushing and refilling apparatus need to be inspected at relatively short intervals and when necessary repaired or replaced, in which case they must be wholly or partly removed from the cistern.

In prior art, constructions this entails the unfastening of a number of screw connections, cotter pins etc.; a relatively time-consuming operation which must be carried out by skilled workers. The reinstallation of the removed parts entails similar problems, with the addition that certain adjustments of said parts and mating parts of the cistern are necessary. In view of the fact that it is generally unsuitable to unfasten and remove the cistern, among other things because of sealing difficulties, the plumber's working conditions are far from ideal as regards working position, space and visibility.

Attempts, partially successful, have already been made to solve these problems. Thus, U.S. patent application Ser. No. 362,570, filed May 21, 1973, now Pat. No. 3,934,276 disclosed in FIG. 4 an embodiment which involves a concentration of certain vital parts of a flushing and refilling apparatus to form a single unit, thereby facilitating assembly and dismounting for inspection purposes. However, also this construction may be improved as far as performance, assembly and maintenance are concerned.

The object of the present invention is to provide a flushing and refilling apparatus substantially of the type described above but improved to facilitate assembling and dismounting of individual main components of the apparatus in relation to each other as well as to the flushing cistern in which the apparatus is intended to be used.

Another object is to provide a flushing and refilling apparatus having its main components supported by a common support or frame which together with said main components forms a unit having means for easily mounting this unit in position in the cistern and for easily dismounting it for repair or replacement, substantially without requiring any readjustments of the apparatus in the cistern.

Accordingly, this invention relates to a detachable flushing and refilling apparatus for use with flushing cisterns, having a discharge opening, said apparatus comprising a refilling valve, a flushing valve seat with an outlet to said discharge opening, an overflow member connected to the outlet, a liftable flushing valve for closing the flushing valve seat, and an operating device having a lifting mechanism for lifting the flushing valve to open position in relation to said valve seat, said flushing valve being arranged to return to closed position by gravity, and a refilling valve closing means movably mounting in said overflow member and arranged to be lifted by said lifting mechanism to an upper position and returned to a lower position by being hit by or filled with water flowing into the overflow when the container has been filled by the refilling valve to the upper rim of the overflow, thereby to close the refilling valve by the intermediary of said operating means connected to said closing means, wherein the overflow, the refilling valve closing means movably disposed in the overflow, said operating means and said lifting mechanism are mounted for easy detachment in a support or frame and, together with said frame, form a unit including a coupling device for easily detachable connection with said flushing cistern.

Thus, in the apparatus according to the present invention several vital parts, such as the flushing valve, the overflow, the entire operating mechanism for the flushing valve and refilling valve and the support for these parts are concentrated to and assembled in a space-saving integral unit which can be removed from the cistern by a few simple manipulations. A new or renovated replacement unit can be inserted in the cistern as quickly as the old unit is removed. In the preferred embodiment of the apparatus according to the invention the flushing valve seat and the refilling valve are also included in this unit. The necessary servicing of the cistern proper can thereby be further simplified and be carried out in 1 or 2 minutes also by persons not skilled in plumbing. Moreover, a water closet having a flushing cistern equipped with an apparatus according to this invention need not be out of use for any appreciable length of time, and, if necessary, the entire replacement operation can be carried out by any handyman without requiring the services of a professional plumber.

Figure 2:
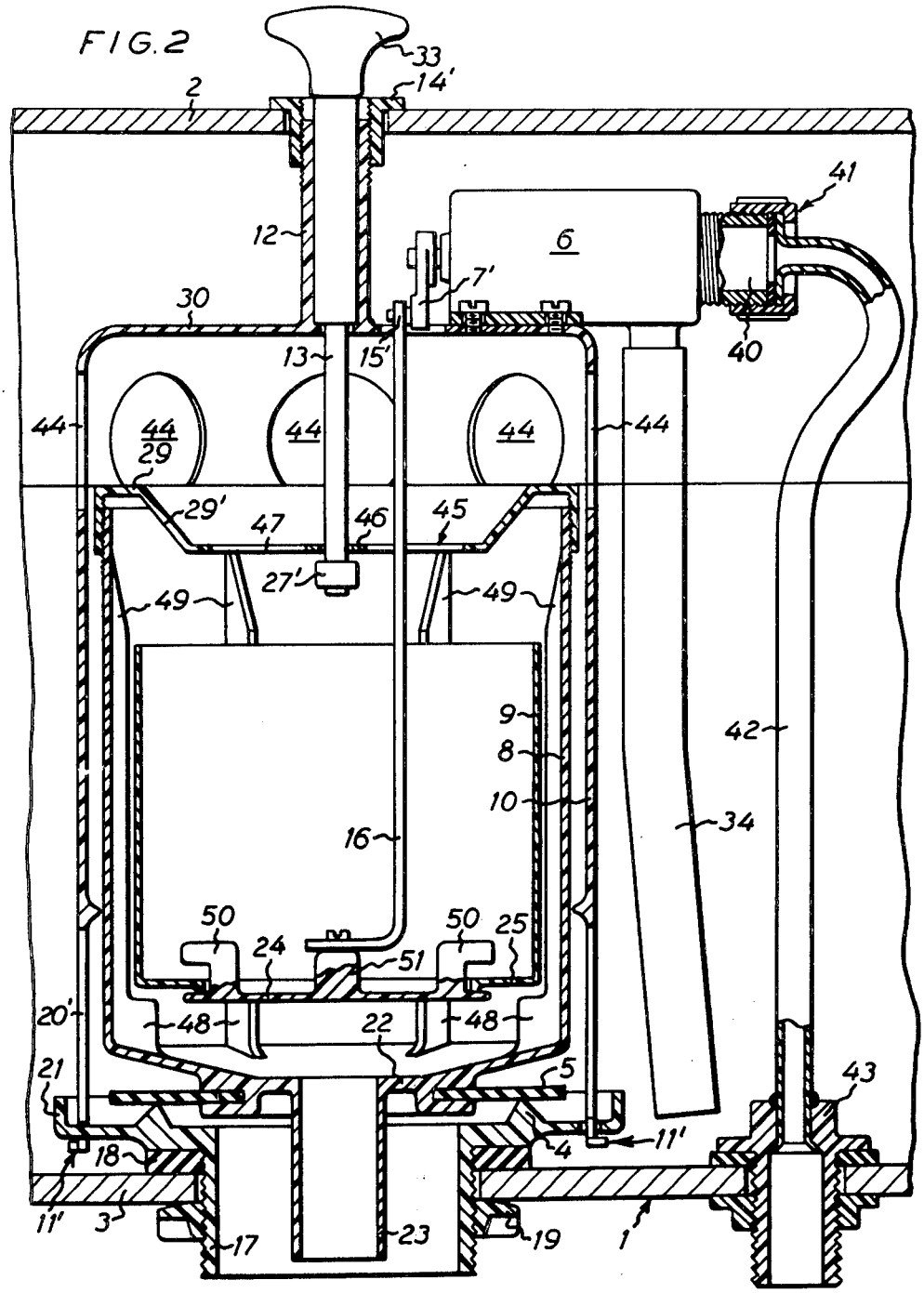

Embodiments of the invention will be described in greater detail hereinbelow and with reference to the accompanying drawings in which:

FIG. 1 is a vertical section of a flushing and refilling apparatus according to the present invention mounted in a flushing cistern, the flushing cistern proper being shown only fragmentarily; and FIG. 2 is a similar view of a modification of the apparatus according to the present invention.

As in U.S. patent application Ser. No. 362,570, and in particular the construction shown in FIG. 4 therein, the embodiment of the flushing cistern illustrated in FIG. 1 of the present application comprises a substantially conventional container 1 with a cover 2, and a bottom 3 with a flushing valve seat 4. The cistern has a flushing valve 5 with an operating mechanism, a refilling valve 6 with a crank or operating arm 7, a discharge or overflow vessel 8, and a cup or vessel 9 placed within the discharge or overflow vessel 8. According to the invention, these parts are assembled as a unit and have a common support or frame 10. As will be apparent from the following, this support or frame 10 is preferably in the for of a housing for other vital parts of the apparatus according to the invention.

The vessel 8 and the cup 9 are, for practical reasons, provided with cylindrical vertical walls and the cup 9 is lodged coaxially in the vessel 8, which in turn is lodged coaxially in an outer cylindrical element having a perforated wall and forming the frame 10 of the unit. The frame 10 is easily detachably connected to the cistern. At the bottom the frame 10 is connected by means of a suitable type of quick coupler 11 to the valve seat 4 attached to the bottom 3 of the cistern 1. Said quick coupler preferably permits unfastening of the frame 10 without the use of tools. However, the top of the frame 10 is releasably connected to the cover 2 of the cistern by means of a tube 12 which forms a guide tube for a lift stem 13 which lifts the flusing valve 5 by the intermediary of the discharge vessel 8 for flushing and opens the refilling valve 6.

As will be appreciated from the drawings, the tube 12 is integral with the frame 10 which, together with the tube 12, forms a bottle-like structure. The tube 12 is connected, at its upper, threaded end, to the cistern cover 2 by means of a ring nut 14 which, on the outer side of the cistern cover 2, is disposed on the threaded end of the tube and rests on the upper side of the cistern cover. The frame 10 thus forms a firmly fixed part in the cistern and can be removed from the cover 2 and the bottom 3 of the cistern with a few simple manipulations. After release of a detachable articulated joint coupling 15 between the operating arm 7 of the refilling valve 6 and a link 16 connecting the arm 7 to the cup 9, a unit comprising the frame 10, the discharge vessel 8, the cup 9, the lift stem 13 with its associated parts, the link 16 and the flushing valve 5 can be removed from the cistern. The inspection completed, this unit (or an identical replacement unit) can be mounted in the cistern in the same simple way.

The flushing valve seat 4 is integral with a short outlet 17 which is externally threaded and is mounted in a hole in the bottom 3 of the cistern. The flushing valve seat rests on the bottom 3 of the cistern by the intermediary of a sealing ring 18 disposed on the outlet 17, and is held tightly clamped against the bottom by means of a ring nut 19 on the outlet 17. The valve seal 4 is substantially disc-shaped displays, at its periphery, a number of vertically upwardly directed supports 20 which engage, by bayonet clutch action, in slots in an outwardly flared lower flange 21 of the frame 10. The bayonet clutch formed by the supports 20 and the slots in the flange 21 make up the above-mentioned quick coupler 11.

In the illustrated embodiment, the flushing valve 5 consists of a replaceable, planar annular disc of soft rubber which is forced into a radial groove about the bottom 22 of the discharge vessel 8. The bottom 22 is not closed, but its central portion is extended downwardly to form a tubular outlet nozzle 23. When the flushing valve 5 is wholly or partly closed, the nozzle 23 extends downwardly into the outlet 17. As a result, the nozzle 23 will, on flushing, partially throttle the water flow through the outlet 17.

In the construction according to FIG. 4 of the aforementioned U.S. patent application, the flushing valve is connected to a discharge vessel which contains, in its lower region, a buoyant body on which it floats during the flushing operation, until the water in the cistern has flowed out through the bottom outlet of the cistern to such a low level that the discharge vessel, because of its weight, sinks down onto the flushing valve seat and closes the flushing valve, whereupon the water in the discharge vessel runs out through the outlet.

It has, however, proved that if the nozzle 23 has approximately the same length as the maximum lifting height of the flushing valve 5, and if its outer diameter is greater than 40% of the inner diameter of the outlet 17, the discharge vessel 8 will, during the flushing operation, keep afloat in the same manner as does the discharge vessel in said prior-art construction, without the need of a special buoyant body which has consequently been dispensed with in the embodiment according to the present invention.

According to the invention, the refilling valve 6 is detachably mounted in a clamp 10'' carried by a bracket 10' which protrudes from the frame 10. The valve 6 is also easily detachably connected to an inlet pipe (not shown) and adapted to be operated by the lift stem 13 via the cup 9. The cup 9 which is suspended in the frame 10 via the valve 6 and the link 16 is here provided with a loose, planar bottom to which the lower end of the link 16 is pivoted, and the circumferential wall of the cup 9 is provided, at its lower end, with an annular inwardly directed flange 25 by which said circumferential wall rests on the bottom 24 of the cup. As will appear from the following, the bottom of the cup 9 forms a drain valve for water in the cup. The casing of the cup is provided at its bottom, with vertical, downwardly directed rod-shaped projections 26 which serve as guides for the bottom of the cup but do not prevent the outflow of water to the outlet nozzle 23. The projections are, moreover, arranged to lift the casing of the cup relative to its bottom 24 if the distance between the bottom 24 of the cup and the bottom 22 of the discharge vessel 8 is sufficiently reduced.

The lift stem 13 supports, at its lower end, a spider-like yoke 27 extending into the cup 9 and clasped by a radially inwardly directed upper flange 28 of the cup 9. The yoke 27 is shiftable relative to the inside of the cup but engages with the upper flange 28 of the cup 9 when it is lifted by means of the lift stem 13. Furthermore, the upper side of the yoke is designed to engage with a radially inwardly directed collar 29 at the upper end of the discharge vessel 8 so as to entrain the vessel 8 upwardly in response to continued lifting of the lift stem. The upper extreme position is limited by the collar 29 abutting against a wall portion 30 which forms a horizontal transition between the vertical circumferential wall of the frame 10 and the tube 12.

Moreover, the yoke 27 is arranged to engage a shoulder 31 on the link 16 which extends from the operating arm 7 of the refilling valve 6 freely through an opening in the frame wall 30, through the upper opening of the discharge vessel 8 defined by the collar 29 and through an opening in the yoke 27 down to the bottom 24 of the cup 9.

When the yoke 27 is lifted by the lift stem 13, the yoke first lifts the casing of the cup 9, the bottom 24 of the cup being retained in its lowermost position, as shown on the drawing. The yoke then engages with the link 16 and lifts it up, the bottom 24 of the cup being also lifted and the refilling valve 6 being operated by the intermediary of the link 16 and the arm 7 for switching to the open position. Finally, the yoke engages with the collar 29 of the discharge vessel 8 and lifts the discharge vessel.

The collar 29 of the vessel 8 is in the form of a lid which has been screwed onto a threaded upper end portion of the vessel 8 to facilitate installation and removal of the cup 9 and to permit a certain adjustment of the collar 29 in relation to the yoke 27.

As shown on the drawing, a water conducting, conical disc 32 is mounted at the underside of the yoke 27 with a hole to allow the passage of the link 16, has a relatively large cone angle and extends almost to the casing of the cup 9. As a result, a narrow inflow gap is formed between the edge of the disc 32 and the casing of the cup, the width of the gap being sufficient to allow inflowing water to run down into the cup 9 without running over its edge, but sufficiently narrow such that the water flows down along the inner face of the cup casing so that the water does not fall freely thereby causing splashing noises. Experiments have shown that it is possible to achieve this dimensional compromise.

The flushing and refilling mechanism according to the present invention operates in the following manner.

When the lift stem 13 and the yoke 27 are lifted by the handle 33, the yoke 27 first lifts the casing of the cup 9, then the link 16 together with the bottom 24 of the cup, and finally the discharge vessel 8. Thus, the casing of the cup 9 is first lifted relative to the bottom 24 of the cup which, at this point, in its function as drain valve for the cup, assumes the open position, thereby allowing water which may possibly remain in the cup to flow out through the outlet nozzle 23. Subsequently, the link 16 swings the operating arm 7 upwardly (the bottom of the cup still remaining open) so as to open the refilling valve 6, and finally the flushing operation is initiated when the discharge vessel 8 and the flushing valve 5 mounted on the discharge vessel are raised.

The intention with this operational sequence and with the described arrangement in general is that water which may remain in the cup 9, in the event of two flushing operations following rapidly upon each other, shall have time to leave the cup 9, since otherwise the remaining water would serve as an extra weight when the mechanism is lifted by the handle 33. A much more serious risk is that the cup, because of the weight of this remaining water, would fall immediately as soon as the handle 33 were released, with the result that the link 16 would close the refilling valve 6 too early. Furthermore, the described sequence ensures that the refilling valve 6 is opened before the flushing operation has begun, since otherwise the refilling valve could remain closed if the lifting of the handle 33 were not fully completed but were interrupted as soon as the flushing operation has commenced.

When the handle 33 is released and the lift stem 13 with the yoke 27 begins to fall back to its lower initial position, the casing of the cup 9 is lowered so that it comes into contact with, and reseals the bottom 24 of the cup, although both the casing and the bottom of the cup are still located at a higher level than that of the shown position of preparedness for flushing. Thus, the refilling valve 6 will remain open and the discharge vessel 8 will remain in its raised position because of its buoyancy in the water.

Despite the fact that the casing of the cup is arranged to be lifted, on flushing, in relation to the bottom of the cup, for discharging water which may possibly remain in the cup, it is possible that this water does not have time to run out if the handle 33 is lifted and then released very quickly. The weight of the water remaining in the cup can then cause the cup to fall down, but if this occurs the cup will only fall a short distance insufficient to occasion closing of the refilling valve 6. The reason for this is that the projections 26 will, in this instance, hit the bottom 22 of the discharge vessel 8 with the result that the bottom 24 of the cup will be opened by the water pressure in the cup and will remain open throughout the flushing operation, that is to say, for several seconds; it is thereby ensured that the cup 9 will, under any circumstances, be completely emptied. When the flushing operation is completed the discharge vessel 8 falls down and recloses the bottom 24 of the cup.

When the flushing valve 5 has been closed, water begins to fill the cistern 1, flowing in via the refilling valve 6 through an inlet pipe 34 which opens, in a per se known manner, near the bottom 3 of the cistern, so as to avoid splashing noises. The filling continues until the water has reached its maximum level, whereupon the water in the cistern flows over the collar 29 and is guided down into the cup 9 by the downwardly directed edge portion 29' of the collar. As the weight of the cup increases, the cup falls down closing the refilling valve 6.

The above-described embodiment of the flushing and refilling mechanism according to the present invention can be modified in many ways without deviating from the principle of the invention. For example, the frame 10 in the illustrated embodiment forms a relatively enclosed housing (apart from the aperture 35 in the lower region of the frame and an opening at the top for the entry of water and the passage of the link 16). This configuration is not necessary, since the frame 10 could well comprise a more open construction, for example, in the form of a cage. The frame 10 would, instead of the shown bayonet clutch 11 with the upwardly directed support arms 20 of the flushing valve seat 4, display downwardly directed arms connected to the flushing valve seat 4 by a suitable quick coupler, for example, a bayonet clutch. The illustrated embodiment in which the frame 10 is detachably connected to the flushing valve seat 4 could also be modified such that the frame is connected (possibly detachably) to the valve seat, which in turn is easily detachably connected to the bottom 3 of the cistern by means of a coarse thread, in which case the frame 10 can be removed as a unit together with the flusing valve seat 4, the discharge vessel 8, the cup 9, the yoke 27 with the lift stem 13 and the link from the operating arm 7, release of the ring nut 14, and removal of the cover 2). Other modifications are possible for the construction of the yoke 27 and the collar 29 on the discharge vessel 8 serving as an over-flow pipe.

FIG. 2 shows a further improvement which essentially comprises the integration of the refilling valve 6 and the inlet pipe 34 in the easily dismountable unit which, in the embodiment of FIG. 1, consists of the overflow discharge vessel 8 with the flushing valve 5, the cup 9, the lift stem 13 and the common frame 10.

In the embodiment of FIG. 2, in which details corresonding in principle to those of FIG. 1 are provided with the same reference numerals, the refilling valve 6 is detachably mounted on the horizontal wall 30 forming a transition wall between the vertical wall of the frame 10 and the guide tube 12. The inlet 40 of the valve 6 is releasably connected to a pipe 42 by means of a sleeve coupling 41, the pipe 42 being connected to a connecting nipple 43 in the bottom 3 of the cistern. Thus, the frame 10 with the guide tube 12, the refilling valve 6, the inlet pipe 34, the overflow/discharge vessel 8 with the flushing valve 5 and the cup 9 and the operating links 7′ and 16 for the refilling valve and the lift stem 13 together form a unit which can easily be separated at the bottom, at the quick coupler 11′, from the collar 21 of the flushing valve seat 4; and at the top from the cistern cover 2 by a flanged pipe unit 14′, holding the guide tube 12 fixed to the cover of the cistern. The removal of the unit is effected by unscrewing the nut 14′, removing the cover 2 and unscrewing the manually turnable sleeve nut of the sleeve coupling 41 so that the refilling valve 6 is loosened from the pipe 42, whereupon the entire unit is manually turned a fraction of a revolution for its release from the flushing valve seat 4 at the bayonet clutch 11′. The unit can then be lifted up and removed from the cistern. The reinstallation of the unit (or of a replacement unit) can be carried out just as simply.

The embodiment in FIG. 2 is also simpler than that of FIG. 1 as regards certain other details and functions. The top of the bottle-like frame 10 is provided, in the region slightly below the wall 30, with a number of water passages 44 and with large recesses at its lower end portion, leaving vertical support legs 20′ which replace the supports 20 on the flushing valve seat 4 in FIG. 1 and the detachably connected to the collar 21 of the flushing valve seat by means of the bayonet clutch 11′. The yoke 27 of FIG. 1 is replaced by a head 27′ at the lower end portion of the lift stem 13, the head freely extending through a hole in a lid 45 screwed onto the upper end of the discharge vessel 8. The outer section of the lid comprises portions 29, 29′ which correspond to the collar 29 and its water conducting disc 29′ in the embodiment of FIG. 1. Spacious water passage holes are disposed at 47 in the lid 45 in the region between its central portion 46 and the water conducting lid portion 29′. As the head 27′ is lifted by the lift stem 13, it engages, at the bottom end of the stem, with the underside of the central lid section 46 and lifts the vertical casing of the discharge vessel 8 instead of the cup 9 as in the embodiment of FIG. 1. The discharge vessel 8 in its turn lifts the cup 9 by means of horizontal shoulders 48 on a number (for example six) of vertical flanges 49 formed, by casting, on the inside of the discharge vessel 8 integrally with the vessel wall and constituting both reinforcements of the vessel wall and guide flanges for the cup 9.

The vertical casing of the cup 9 lifts in turn the bottom 24 of the cup when the radially inwardly directed lower edge flange 25 of the cup casing strikes against catches 50 which are cast in one piece with the bottom 24 of the cup. The catches 50 are shaped such that, on assembly, the bottom of the cup can be suspended from below on the lower edge flange of the casing. After connection of the link 16 through a joint 15′ to a crank arm 7′ which is connected to the rotary valve member of the refilling valve, (in this embodiment, the crank arm replaces the arm 7 of FIG. 1) and after screw connection of the link 16 to a central projection 51 on the bottom of the cup, the catches 50 cannot be unintentionally moved beyond the lower edge flange 25 of the cup casing. As in the embodiment of FIG. 1 the edge flange 25 rests on the upper side of the outer edge portion of the bottom 24 of the cup, in the position shown in FIG. 2, i.e. a position of preparedness in which the refilling valve 6 and the flushing valve 5 are closed. In this position the crank arm 7′ points substantially downwardly. Thus, when the bottom 24 of the cup is lifted in the above-described manner, the crank arm 7′ is swung upwardly by the link 16 and the refilling valve 6 is opened.

It will be understood from the above that flushing is inititated when the discharge vessel 8 is lifted by means of the lift stem 13 and that the refilling valve is opened after a delay determined by the distance between the shoulders 48 and the inwardly directed edge flange 25 of the cup, and the distance between this edge flange and the catches 50. Certainly, this arrangement does not follow the sequence described with reference to the embodiment of FIG. 1 and motivated by the desirability of ensuring the opening of the refilling valve before the opening of the flushing valve 5. However, it has proved that if discharge vessel 8 is highly buoyant in water (high displacement relative to its weight) the flushing will not be interrupted if the handle 33 is only lifted half way and immediately released. If the handle is lifted only as far as to allow the flushing valve 5 to clear the valve seat 4, the discharge vessel 8 will, because of its buoyancy, rise and does not stop rising until it reaches the extreme upper position against the wall 30. In this extreme upper position, the discharge vessel 8 has the same function as in the embodiment of FIG. 1; namely, to prevent possible remaining water from pulling down the cup 9 too early. However, in this embodiment the above-mentioned shoulders 48 at the lower ends of the guide flanges 49 assume the function of the downwardly directed projections 26 on the bottom 24 of the cup 9 in the embodiment of FIG. 1.

Consequently, the same advantages will be obtained as in the apparatus according to FIG. 1, but thanks, instead, to a simplified arrangement which, moreover, incorporates the flushing valve 5 and the inlet pipe 34 in th easily detachable and easily replaceable unit which thus comprises as good as all of the details of the flushing and refilling apparatus. The flushing valve seat 4 can also be incorporated in this unit, this being effected by connecting the seat 4 with the bottom outlet by means of a quick coupler, for example a coarse thread, in which case the quick coupler 11′ can, if desired, be dispensed with.

In the illustrated embodiments most of the details, such as the discharge vessel 8, the cup 9 and also the frame 10 can advantageously be of plastics, but other materials may also be considered.

What we claim and desire to secure by Letters Patent is:

1. A flushing cistern having a flushing and refilling apparatus therein, a bottom discharge opening and a flushing valve seat connected to the bottom discharge opening, said apparatus comprising a refilling valve for regulating the flow of liquid into the cistern, a flushing valve for cooperating with said valve seat, an overflow member providing an overflow passage connecting said discharge opening to an upper level of the cistern, said overflow member being in the form of a cylindrical overflow tube which supports said flushing valve at its lower end and has a restricted tubular portion extending through and sealed in relation to said flushing valve, said tube being mounted coaxially in and guided by said cylindrical housing for vertical movement therein, a manually operatable actuating mechanism for unseating said flushing valve and opening said refilling valve to start a flushing and refilling cycle, a refilling valve closing means mounted in said overflow passage to be weighted by liquid flowing into the overflow member and connected to said refilling valve and to said actuating mechanism to be moved by said actuating mechanism to an upper position upon starting of said cycle and to close said refilling valve when weighted by liquid flowing into the overflow member, said refilling valve closing means including a cylindrical open vessel mounted coaxially in said overflow tube for receiving and collecting liquid when liquid is flowing thereinto, said vessel having a bottom opening and a movable bottom wall member for closing said opening, said bottom wall member being movable relative to said vessel to form a bottom drain valve and being mounted to be opened when lifting force is imparted to said vessel to insure that the vessel may be emptied under movement to its upper position, a support in the form of a cylindrical housing having a vertical axis and at least one opening forming a communication between said cistern and the interior of said housing, said support and said refilling valve, flushing valve, overflow member and refilling valve closing means being assembled to form a unit of assembled parts having said support as a common support, said support and said cistern having mating coupling means forming an easily releasable coupling accessible from within the cistern for mounting and dismounting said unit, and said refilling valve being mounted on said support for supporting said refilling valve closing means.

2. Detachable flushing and refilling apparatus as claimed in claim 1, wherein said cistern comprises a top wall member having an opening, said support comprising an upstanding tubular portion which at least partially encloses said tubular portion of said overflow member, which in turn encloses said vessel of said refilling valve closing means, said support comprising an upper part having a socket for detachably connecting said support to a top wall member in said opening.

3. Detachable flushing and refilling apparatus as claimed in claim 1, wherein said operating mechanism comprises an operating member, said operating member having an outer portion extending to the outer side of said cistern and an inner portion extending into said cistern, and means connected to said operating member to be lifted by operation of said operating member, said overflow member supporting said flushing valve at its lower end portion and being vertically movable therewith, said refilling valve closing means and said means connected to said operating member having adjacent abutting surfaces and said overflow member and said valve closing means having spaced abutting surfaces such that said means connected to said operating member when lifted by the latter will raise said refilling valve operating means to an upper level in said overflow member and raise said overflow member thereby raising said flushing valve to an upper level, to open said refilling valve and, after a short interval, to open said flushing valve.

4. Apparatus as claimed in claim 1, wherein said support includes said flushing valve seat, said flushing valve seat having said mating coupling means of said support and said mating coupling means fixed to said cistern being supported adjacent to said discharge opening for easily detachable connection and disconnection of said flushing valve seat to said discharge opening for connecting and disconnecting said support in relation to said cistern bottom.

5. Apparatus as claimed in claim 1, wherein said operating mechanism comprises an upstanding connecting rod connected at its lower end to said movable bottom wall member and a crank pivoted at its one end to the upper end of said connecting rod and fixed at its other end to the movable valve member of said refilling valve, whereby said movable bottom wall member is suspended by said refilling valve via said crank and said rod and supporting said vessel, said operating mechanism further comprising vessel lifting means for lifting said vessel in said tubular overflow member from said lower position to said upper position, and means for separating said vessel and said bottom wall member during lifting of said vessel to ensure emptying of said vessel and for permitting returning of said bottom wall member to closed position when the lifting movement is accomplished.

6. Apparatus as claimed in claim 5, wherein said means for separating said vessel and said bottom wall member comprise cooperating abutments on said operating mechanism and said vessel and cooperating abutments on said vessel and said bottom wall member.

7. Apparatus as claimed in claim 1, wherein the support has an upper coupling member for detachable connection of said support to an openable cistern cover.

* * * * *